US009177566B2

(12) United States Patent
Åhgren et al.

(10) Patent No.: US 9,177,566 B2
(45) **Date of Patent: *Nov. 3, 2015**

(54) NOISE SUPPRESSION METHOD AND APPARATUS

(75) Inventors: Per Åhgren, Knivsta (SE); Anders Eriksson, Uppsala (SE)

(73) Assignee: TELEFONAKTIEBOLAGET L M ERICSSON (PUBL), Stockholm (SE)

( * ) Notice: Subject to any disclaimer, the term of this patent is extended or adjusted under 35 U.S.C. 154(b) by 779 days.

This patent is subject to a terminal disclaimer.

(21) Appl. No.: 12/809,292

(22) PCT Filed: Dec. 20, 2007

(86) PCT No.: PCT/SE2007/051058

§ 371 (c)(1),
(2), (4) Date: Jun. 18, 2010

(87) PCT Pub. No.: WO2009/082299

PCT Pub. Date: Jul. 2, 2009

(65) Prior Publication Data

US 2010/0274561 A1 Oct. 28, 2010

(51) Int. Cl.
*G10L 21/00* (2013.01)
*G10L 21/0208* (2013.01)

(52) U.S. Cl.
CPC ..... *G10L 21/0208* (2013.01)

(58) Field of Classification Search
USPC ..... 704/226–228, 233
See application file for complete search history.

(56) References Cited

U.S. PATENT DOCUMENTS

| | | | | |
|---|---|---|---|---|
| 4,061,875 | A | 12/1977 | Freifeld et al. | |
| 5,329,243 | A | 7/1994 | Tay | |
| 5,706,395 | A | 1/1998 | Arslan et al. | |
| 6,574,336 | B1 * | 6/2003 | Kirla | 379/406.01 |
| 6,708,145 | B1 | 3/2004 | Liljeryd et al. | |
| 6,862,567 | B1 | 3/2005 | Gao | |
| 2002/0116182 | A1 | 8/2002 | Gao et al. | |
| 2002/0156624 | A1 | 10/2002 | Gigi | |
| 2003/0161420 | A1 * | 8/2003 | Pupalaikis | 375/346 |
| 2005/0058278 | A1 * | 3/2005 | Gallego Hugas et al. | 379/406.01 |
| 2006/0126865 | A1 | 6/2006 | Blamey et al. | |

(Continued)

FOREIGN PATENT DOCUMENTS

| | | | |
|---|---|---|---|
| CN | 1201547 | A | 12/1998 |
| EP | 1926085 | A1 | 5/2008 |

(Continued)

OTHER PUBLICATIONS

Hermansky, H. et al. "Speech Enhancement Based on Temporal Processing." 1995 IEEE International Conference on Acoustics, Speech and Signal Processing (ICASSP'95), vol. 1, pp. 405-408, 1995.

*Primary Examiner* — Leonard Saint Cyr
(74) *Attorney, Agent, or Firm* — Coats & Bennett, PLLC

(57) ABSTRACT

The present invention relates to a method and apparatus of a digital filter for noise suppression of a signal representing an acoustic recording. The method comprises determining a desired frequency response (H(ω)) of the digital filter; and generating a noise suppression filter based on the desired frequency response. The desired frequency response is determined in a manner so that the desired frequency response does not exceed a maximum level, wherein the maximum level is determined in response to the signal to be filtered.

19 Claims, 7 Drawing Sheets

(56) References Cited

U.S. PATENT DOCUMENTS

2008/0117405 A1* 5/2008 Ridder et al. ..... 356/4.01
2008/0120052 A1* 5/2008 Ridder et al. ..... 702/75

FOREIGN PATENT DOCUMENTS

WO 9710586 A1 3/1997
WO 01/18961 A1 3/2001

* cited by examiner

NOISE SUPPRESSION METHOD AND APPARATUS

CROSS-REFERENCE TO RELATED APPLICATIONS

This application is the National Stage of International App. No. PCT/SE2007/051058, filed Dec. 20, 2007, entitled "NOISE SUPPRESSION METHOD AND APPARATUS," and which is hereby incorporated by reference as if fully set forth herein.

TECHNICAL FIELD

The present invention relates to the field of digital filter design. In particular, the invention relates to the field the design of digital filters for noise suppression in signals representing acoustic recordings.

BACKGROUND

Due to the ubiquitous presence of noise in natural environments, real-world sound recordings typically contain noise from various sources. In order to improve the sound quality of sound recordings, a range of methods for reducing the noise level of sound recordings have been developed. Often, in such methods, a time-domain noise suppression filter is computed from a desired frequency response $H(\omega)$, and the time-domain noise suppression filter is then applied to the sound recording.

In an ideal noise suppression filter, the desired acoustic signal should pass through the filter undistorted, while noise should be completely attenuated. These properties cannot be simultaneously fulfilled in a real filter (except in the special case when there is no desired signal or no noise, or when the desired signal and noise are spectrally separated). Hence, in determining a desired frequency response $1/(o)$ of a filter, a trade-off between distorting the desired signal and distorting the noise has to be made for frequencies at which both the desired signal and noise are present.

The desired frequency response $H(\omega)$ can be estimated by means of various methods, such as spectral subtraction. In "Low-distortion spectral subtraction for speech enhancement", Peter Händel, *Conference Proceedings of Eurospeech*, pp. 1549-1553, ISSN 1018-4074, 1995, different aspects of spectral subtraction methods for suppressing noise are discussed. In U.S. Pat. No. 5,706,395, spectral subtraction is discussed and a method of defining the level to which noise should be attenuated is disclosed. In U.S. Pat. No. 5,706,395, the desired frequency response $H(\omega)$ is clamped so that the attenuation cannot go below a minimum value, wherein the minimum value may, according to U.S. Pat. No. 5,706,395, depend on the signal-to-noise ratio of the noisy speech signal to be filtered. The clamping of the desired frequency response of U.S. Pat. No. 5,706,395 prevents a noise suppression filter from fluctuating around very small values, thus avoiding a noise distortion commonly referred to as musical noise.

In many spectral subtraction methods, the desired frequency response is calculated as a function of the signal-to-noise ratio (SNR). Since the SNR of a noisy acoustic signal at a particular frequency varies with time, the desired frequency response $H(\omega)$ is generally updated over time—often, the desired frequency response $H(\omega)$ is updated for each frame of data. An effect of this is that a noise, which is at a constant level in the noisy speech signal, is often attenuated to a level that varies considerably with time in a noticeable manner, resulting in fluctuations of the residual noise. This undesirable effect is often commonly referred to as noise pumping, and can be heard as a shadow voice.

SUMMARY

A problem to which the present invention relates is the problem of how to avoid undesirable fluctuations in the residual noise.

This problem is addressed by a method of designing a digital filter for noise suppression of a signal to be filtered wherein the signal represents an acoustic recording. The method comprises: determining a desired frequency response of the digital filter and generating a noise suppression filter based on the desired frequency response. The method is characterised in that the determining of a desired frequency response is performed in a manner so that the desired frequency response does not exceed a maximum level, wherein the maximum level is determined in response to the signal to be filtered.

The problem is further addressed by a digital filter design apparatus arranged to design a digital filter for noise suppression of a signal to be filtered, wherein the signal represents an acoustic recording. The digital filter design apparatus comprises a desired frequency response determination apparatus arranged to determine a desired frequency response in response to the signal to be filtered, wherein the desired frequency response determination apparatus is arranged to determine a maximum level of the desired frequency response in dependence of the signal to be filtered; and determine the desired frequency response in a manner so that the desired frequency response does not exceed the maximum level.

The problem is also addressed by a computer program product arranged to perform the inventive method.

By determining a maximum level of the desired frequency response of the designed filter in response to the signal to be filtered, undesirable fluctuations in the residual noise can be reduced, and hence, the perceived acoustic quality of the acoustic signal can be improved. For example, if the power density of the signal to be filtered varies with time, the maximum level can be varied at a time scale that is adapted to the time scale of the power density variations in a manner so that the effects on the filtered signal of the power density variations are minimised.

Moreover, the maximum level can also be determined as a function of frequency. By allowing the maximum level to vary with the frequency of the signal to be filtered, the perceived quality of the filtered signal can be improved even further. For example, at low frequencies which typically contain only noise, the maximum level can be set to a lower value than at high frequencies, where speech is often present.

The maximum level of the desired frequency response may advantageously be determined based on a measure of the noise level of the of the signal to be filtered, such as the signal-to-noise ratio or the noise power.

Further advantageous embodiments of the invention are set out by the dependent claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
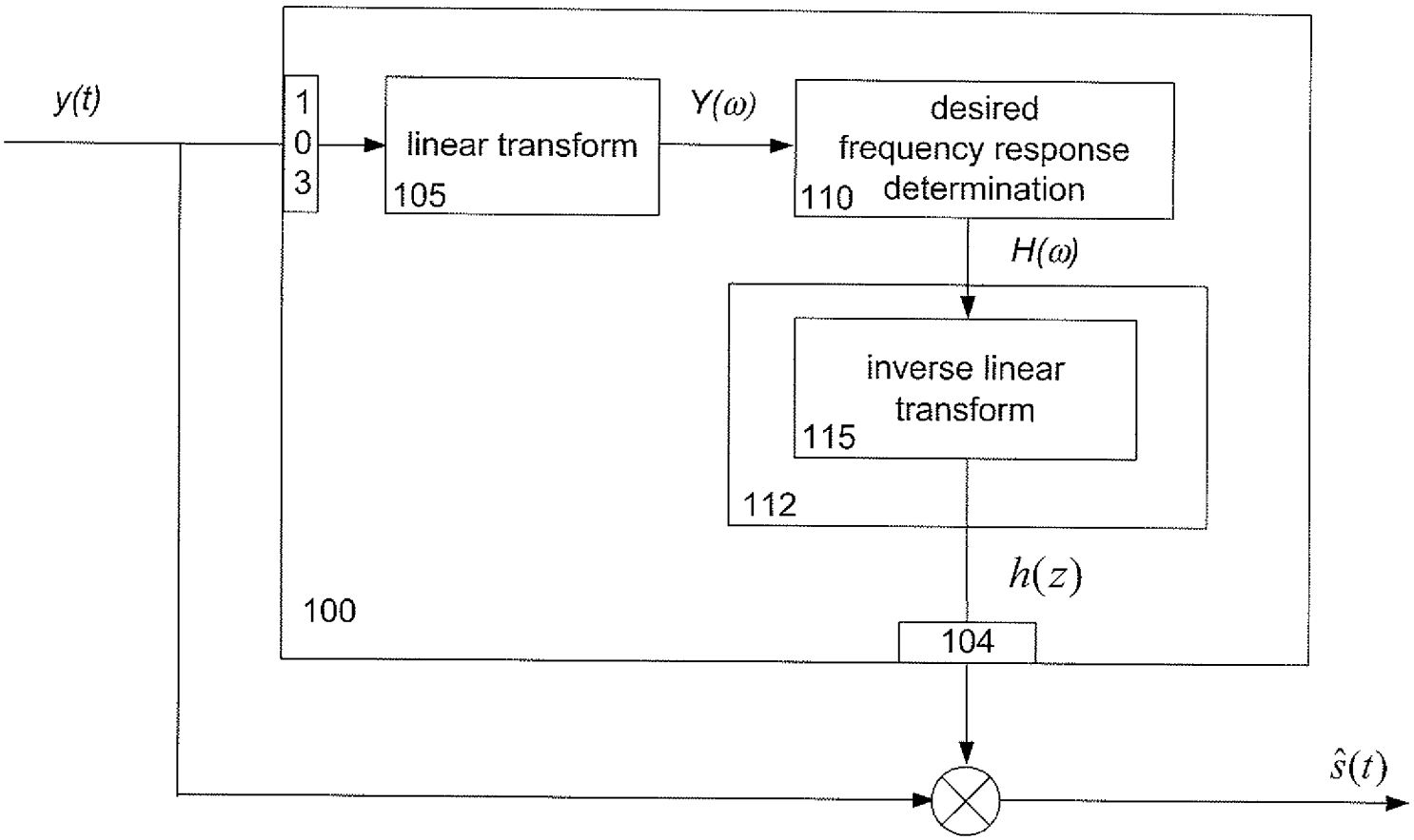
FIG. 1 is a schematic illustration of a digital filter design apparatus.

A noisy speech signal y(t) having a desired speech component s(t) and a noise component n(t) may be denoted:

$$y(t)=s(t)+n(t). \tag{1}$$

In many situations, it is desirable to suppress the noise component n(t) and form an estimate $\hat{s}(t)$ of the speech component in a manner so that the estimated speech component $\hat{s}(t)$ as closely as possible resembles the speech component s(t). One way to do this is by filtering the noisy signal y(t) with a time-domain noise suppression filter h(z) which is designed to remove as much of the noise component n(t) as possible, while retaining as much of the speech component s(t) as possible.

The noise suppression filter h(z) is usually computed from a desired frequency response H(ω), where H(ω) is a real-valued function that is typically designed so that H(ω) is close to zero for frequencies ω at which y(t) only contains noise, H(ω)=1 for frequencies ω at which y(t) only contains speech, and 0<H(ω)<1 for frequencies ω at which y(t) contains noisy speech.

When determining the speech component of a noisy signal, a linear transform F[·] is normally applied to frames of samples of the noisy signal. By assuming the following relation:

$$F[\hat{s}(t)]=H(\omega)F[y(t)] \tag{2}$$

where F[·] denotes a linear transform such as the Fast Fourier Transform (FFT), the noise suppression filter h(z) is obtained as the inverse linear transform $F^{-1}[\cdot]$ of the desired frequency response H(ω). Thus, the speech component estimate $\hat{s}(t)$ is obtained by:

$$\hat{s}(t)=F^{-1}[H(\omega)]\otimes y(t)=h(z)\otimes y(t) \tag{3}$$

where ⊗ denotes convolution.

Hence, in order to arrive at a speech component estimate $\hat{s}(t)$, the desired frequency response H(ω) has to be determined. As mentioned above, 0<H(ω)<1 for frequencies ω at which y(t) contains noisy speech. The value of H(ω) at a particular frequency at which y(t) contains noisy speech is often chosen in dependence of the Signal-to-Noise Ratio (SNR) of the noisy signal y(t) at that frequency.

The desired frequency response H(ω) can be estimated by means of various methods, such as spectral subtraction. Since the SNR at a particular frequency varies with time, the desired frequency response H(ω) is generally updated over time—often, the desired frequency response H(ω) is updated for each frame of data. Hence, the desired frequency response H(ω) typically varies between frames, so that $H(k_n,\omega)\neq H(k_{n+1},\omega)$, where $k_n$ denotes the timing of a frame having frame number n. Alternatively, the desired frequency response H(ω), and hence the filter arrangement determined from the desired frequency response, can be updated at a different time interval. Thus, the desired frequency response and the filter arrangement vary with time. However, in order to simplify the description, this time dependency of H(ω) and h(z) will, in the expressions below, generally not be explicitly shown.

When determining the desired frequency response H(ω) in a spectral subtraction method, the following expression is often used:

$$H(\omega)=\left(1-\delta(\omega)\left(\frac{\hat{\Phi}_n(\omega)}{\hat{\Phi}_y(\omega)}\right)^{y_1}\right)^{y_2}. \tag{4}$$

where $\hat{\Phi}_n(\omega)$ and $\hat{\Phi}_y(\omega)$ are estimates of the power spectral densities of n(t) and y(t) respectively, and δ(ω) is an over-subtraction factor used to reduce musical noise. As discussed above, it is often advantageous to limit the suppression of noise to a level $H_{min}$ in order to limit small fluctuations of the residual noise often denoted musical noise. Expression (4) then takes the form:

$$H(\omega)=\max\left\{\left(1-\delta(\omega)\left(\frac{\hat{\Phi}_n(\omega)}{\hat{\Phi}_y(\omega)}\right)^{y_1}\right)^{y_2},\ H_{min}\right\}. \tag{4a}$$

$\gamma_1$ and $\gamma_2$ are factors determining the sharpness of the transition between H(ω)≈1 and $H(\omega)=H_{min}$. When $\gamma_1=\gamma_2=1$, expression (4) is often denoted the Wiener filtering approach.

FIG. 1 illustrates a filter design apparatus 100 arranged to generate an appropriate noise suppression filter h(z) based on a received sampled noisy speech signal y(t). Filter design apparatus 100 has an input 103 for receiving the noisy speech signal y(t) to be filtered, and an output 104 for outputting a signal representing the designed digital filter h(z). Filter design apparatus 100 comprises a linear transform apparatus 105 arranged to receive the sampled noisy speech signal y(t) and to generate the linear transform Y(ω) of the sampled noisy speech signal y(t). Filter design apparatus 100 of FIG. 1 further comprises a desired response determination apparatus 110 arranged to receive the linear transform Y(ω) of the sampled signal y(t) and to determine the desired frequency response H(ω) based on the linear transform Y(ω). Filter design apparatus 100 further comprises a filter signal generation apparatus 112 comprising an inverse linear transform apparatus 115 arranged to receive the desired frequency response H(ω) and to generate the inverse linear transform of the desired frequency response H(ω). Generally, the output of the inverse linear transform apparatus 115 is further processed in filter signal generation apparatus 112, for example in the manner described in U.S. Pat. No. 7,251,271, in order to obtain the filter h(z). The output of the filter signal generation apparatus 112 is a signal representing the filter h(z), and the output of filter signal generation apparatus 112 is advantageously connected to output 104 of filter design apparatus 100.

In an ideal noise suppression technique, any speech should pass undistorted. Hence, H(ω) should fulfil H(ω)=1 for all frequencies at which the noisy speech signal y(t) comprises a speech component s(t). On the other hand, an ideal noise suppression technique should attenuate any noise to a desired noise level $H_{min}$, requiring that $H(\omega)=H_{min}$ for all frequencies at which the noisy speech signal y(t) comprises a noise component n(t).

The desired properties above can generally not be fulfilled at the same time, since speech and noise are often simultaneously present at the same frequencies. Hence, in determining a desired frequency response $H(\omega)$ of a filter, a trade-off between distorting the speech and distorting the residual noise has to be made for frequencies at which both speech and noise are present. When $H(\omega)\neq H_{min}$ at frequencies at which speech is present, the speech is said to be distorted. When $H(\omega)\neq H_{min}$ at frequencies at which noise is present, the residual noise is said to be distorted, where the residual noise is defined as $$n^{residual}(t)=h(z)\otimes n(t). \tag{5}$$

According to the invention, the desired frequency response is selected in a manner so that an appropriate maximum level of $H(\omega)$ is applied, wherein the maximum level is selected in response to the noisy speech signal y(t). As will be seen below, the maximum level may be chosen such that the distortions in the speech and residual noise may be limited in a controlled manner. Fluctuations of the noise attenuation, as well as other effects of noise and speech distortion, may thereby be reduced.

Figure 2A:
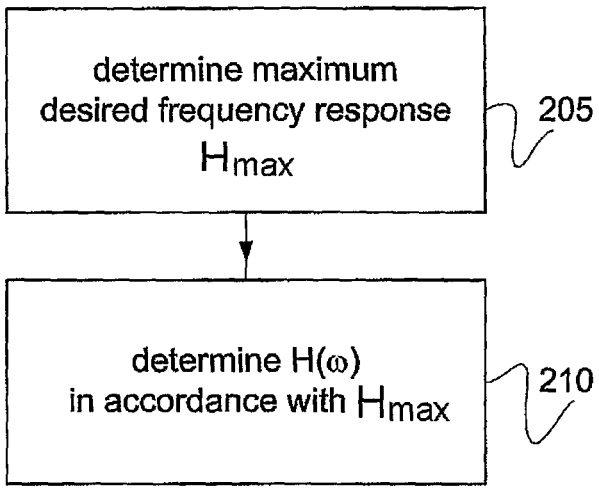
FIG. 2*a* is a flowchart illustrating an embodiment of the inventive method.

In FIG. 2*a*, a flowchart illustrating an inventive method of determining the desired frequency response $H(\omega)$ is shown. In step 205, a maximum level $H_{max}$ of the desired frequency response is determined in dependence of the noisy speech signal y(t)—more specifically, the maximum level $H_{max}$ can advantageously be determined in dependence of the linear transform $Y(\omega)$ of the noisy speech signal y(t). $H_{max}$ could be determined based on the present time instance of the noisy speech signal y(t), i.e. the time instance of the noisy speech signal to which the instance to be determined of the filter h(z) is to be applied; on time instance(s) of the noisy speech signal y(t) that precedes the time instance to which the instance to be determined of the filter h(z) is to be applied, or to a combination of present and previous time instances of the noisy speech signal y(t). $H_{max}$ may or may not be a function of frequency ω. In order to reflect this possibility, the maximum level of $H(\omega)$ will in the following be denoted $H_{max}(\omega)$. Furthermore, $H_{max}(\omega)$ may or may not vary between different points in time. However, this variation will in the following generally not be explicitly shown. $H_{max}(\omega)$ can be determined in a number of different ways, of which some are described below.

When $H_{max}(\omega)$ has been determined in step 205, step 210 is entered, wherein the desired frequency response $H(\omega)$ is determined in accordance with $H_{max}(\omega)$. In one implementation of the invention, $H(\omega)$ could for example be chosen to be equal to $H_{max}(\omega)$ for all frequencies ω above a change-over frequency $\omega_0$, and be equal to a minimum level $H_{min}$ of the desired frequency response for frequencies lower than $\omega_0$. In this implementation, the change-over frequency $\omega_0$ could for example be determined as the frequency below which the power of the speech component s(t) of the noisy speech signal is smaller than a threshold value, or in any other suitable manner.

Figure 2B:
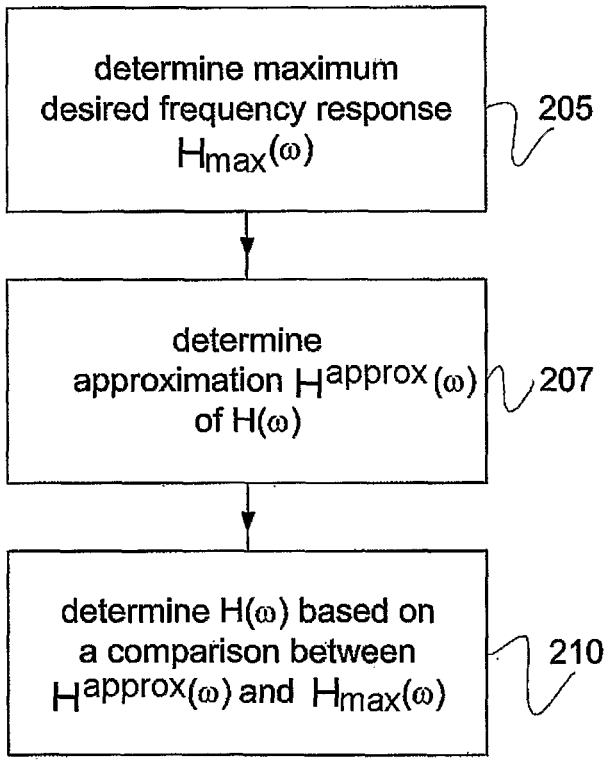
FIG. 2*b* is a flowchart illustrating an embodiment of the inventive method.

FIG. 2*b* illustrates an implementation of the inventive method wherein the step 205 of determining the desired frequency response is performed in dependence of an approximation $H^{approx}(\omega)$ of the desired frequency response, as well as in dependence of the maximum level $H_{max}(\omega)$. In step 205 of FIG. 2*b*, the maximum level $H_{max}(\omega)$ is determined (cf. FIG. 2*a*). Step 207 is then entered, in which an approximation $H^{approx}(\omega)$ of the desired frequency response is determined based on the linear transform $Y(\omega)$ of the sampled signal y(t). This approximation $H(\omega)$ of the desired frequency response can for example be obtained by use of expression (4). Step 210 is then entered, in which a value of $H(\omega)$ is determined based on a comparison between the approximation $H^{approx}(\omega)$ of the desired frequency response and the maximum value $H_{max}(\omega)$ of the desired frequency response. Such determination could for example be performed by use of the following expression:

$$H(\omega)=\min\{H^{approx}(\omega),H_{max}(\omega)\} \tag{6}.$$

The selection expressed by expression (6) should preferably be made for each frequency bin for which a value of $H(\omega)$ should be determined. Hence, step 210 of FIG. 2*b* should preferably be repeated for each frequency bin for which a value of $H(\omega)$ should be determined. However, there may be situations where the limitation of the maximum level of the desired frequency response is less advantageous for some parts of the frequency spectrum. In implementations relating to such implementations, step 210 should only be repeated for the frequency bins for which a limitation of the maximum value of the desired frequency response is desired.

Step 207 could alternatively be performed prior to step 205.

A check as to whether the value $H^{approx}(\omega)$ is smaller than a minimum value of the desired frequency response, $H_{min}$, could be included in the method of FIG. 2*b* (as well as in the method of FIG. 2*a*).

Expression (6) could then advantageously be altered as follows:

$$H(\omega)=\max\{\min\{H^{approx}(\omega),H_{max}(\omega)\},H_{min}\} \tag{6a}$$

or as follows:

$$H(\omega)=\min\{\max\{H^{approx}(\omega),H_{min}\},H_{max}(\omega)\} \tag{6b}$$

Whether to use expression (6a) or (6b) depends on whether it is desired that $H(\omega)$ takes the value $H_{max}(\omega)$, or the value $H_{min}$, when $H_{min}>H_{max}$. Just like $H_{max}(\omega)$, $H_{min}$ could vary with frequency, and could take different values at different point in time.

As mentioned above, $H_{max}(\omega)$ could be set to a fixed value, which applies to all frequencies and/or all points in time. When $H_{max}(\omega)$ is independent of time and frequency, a value of $H_{max}<1$ would serve to limit the difference in noise suppression at a particular frequency between points in time where speech is present and points in time where noise only is present, i.e. the fluctuations of the residual noise may be reduced. Distortion of speech would then always occur at least to the extent determined by $H_{max}$. However, in order to reduce the distortion of speech, as well as improve the possibility of obtaining efficient reduction of the fluctuations of the noise attenuation, it is advantageous to introduce a maximum desired frequency response $H_{max}(\omega)$ that varies with both frequency and time.

The value of $H_{max}(\omega)$ determined in step 205 of FIG. 2 can for example be derived based on a measure of the noise level of the noisy speech signal y(t), such as the signal-to-noise-ratio $SNR(\omega)$ of the noisy speech signal y(t), the $SNR(\omega)$ of the speech component estimate $\hat{s}(t)$ at different frequencies, or the overall signal to noise ratio $\hat{SNR}(t)$ of the speech component estimate $\hat{s}(t)$ etc., where "overall" refers to that an integration is performed over the relevant frequency band (cf. expression (14) below). Other measures could alternatively be used for determining $H_{max}(\omega)$. Such other measures should preferably be related to a signal-to-noise ratio: For example, the determination of $H_{max}(\omega)$ can be based on the noise power level $P_n(t,\omega)$ of the noisy speech signal y(t) at different frequencies, or on the overall noise level $\hat{P}_n(t)$ of the noisy speech signal. Measures of the noise power level of the signal y(t) can be seen as measures of a signal-to-noise ratio, where the signal power is assumed to be of a certain value. The value of $H_{max}(\omega)$ could alternatively be based on the power level of the noisy speech signal y(t), or on any other measure of the noisy speech signal y(t).

$H_{max}$ Based on a Worst Case Consideration of SNR(t,ω)

Since the SNR of the estimated speech component ŝ(t) obtained for a particular time period depends on H(ω) when H(ω) varies over that time period (see below), an expression for $H_{max}(\omega)$ can for example be derived from a worst case consideration of the SNR(ω) of the speech component estimate ŝ(t).

The SNR(ω) of the speech component estimate ŝ(t) can be expressed as:

$$SNR(\omega) = \frac{\hat{\Phi}_{\hat{s}}(\omega)}{\hat{\Phi}_{n^{residual}}(\omega)} \approx \frac{H(\omega)\{\hat{\Phi}_y(\omega) - \hat{\Phi}_n(\omega)\}}{H(\omega)\hat{\Phi}_n(\omega)} \tag{8}$$

where $\hat{\Phi}_{\hat{s}}$, $\hat{\Phi}_y$, $\hat{\Phi}_n$ are estimates of the spectral densities of the estimated speech component ŝ(t), the noisy speech signal y(t) and the noise component n(t), respectively, and $\hat{\Phi}_{nresidual}(\omega)$ is an estimate of the spectral density of the residual noise, $n^{residual}(t)$.

Instantaneously, the SNR(ω) of g(t) for a certain frequency ω is independent of H(ω) (and equal to the SNR of y(t) at that frequency) (assuming that H(ω)>0 for all ω), as can be seen from expressions (1)-(3) and (8) above. However, in contrast to the instantaneous SNR, the SNR for a certain time period is typically dependent on H(ω) when H(ω) varies over that time period. To illustrate this, the following simple example is considered, wherein the SNR is determined based on two samples $y(t_A)$ and $y(t_B)$, collected at two different time instants $t_A$ and $t_B$, and wherein the sample obtained at $t_A$ contains noisy speech: $y(t_A)=s(t_A)+n(t_A)$ and the sample at $t_B$ contains only noise: $y(t_B)=n(t_B)$. Assuming that the desired frequency response H(ω) for a certain frequency ω takes different values at the different moments in time, such that $H(t_A,\omega)\neq H(t_B,\omega)$, the SNR of ŝ(t) for the frequency ω based on these two samples could be expressed as:

$$SNR(\omega) = \frac{\hat{\Phi}_{\hat{s}}(t_A, \omega) + 0}{\hat{\Phi}_{n^{residual}}(t_A, \omega) + \hat{\Phi}_{n^{residual}}(t_A, \omega)} \approx \frac{H(t_A, \omega)\left\{\begin{matrix}\hat{\Phi}_y(t_A, \omega) - \\ \hat{\Phi}_n(t_A, \omega)\end{matrix}\right\}}{H(t_A, \omega)\hat{\Phi}_n(t_A, w) + H(t_B, \omega)\hat{\Phi}_n(t_B, \omega)}. \tag{8a}$$

The SNR in expression (8a) is clearly dependent on H(ω), since $H(t_B,\omega)$ is only present in the denominator of expression (8a).

A worst case SNR will be given when assumed that speech is maximally attenuated and noise is minimally attenuated. For a frequency ω, this can be denoted as $$SNR_{worst\ case}(\omega) \approx \frac{H_{min}^2(\hat{\Phi}_y(\omega) - \hat{\Phi}_n(\omega))}{H_{max}^2(\omega)\hat{\Phi}_n(\omega)}. \tag{9}$$

In order to limit the worst case SNR, a minimum value β of the worst case SNR may be provided, where β may be a function of frequency:

$$SNR_{worst\ case}(\omega) = \frac{H_{min}^2(\hat{\Phi}_y(\omega) - \hat{\Phi}_n(\omega))}{H_{max}^2(\omega)\hat{\Phi}_n(\omega)} \geq \beta(\omega). \tag{10}$$

In expression (10), β(ω) forms a lower limit for the worst case SNR. β will in the following be referred to as the tolerance threshold. The tolerance threshold β should preferably be given a value greater than zero for all frequencies.

Expression (10) yields the following expression for the maximum level of H(ω):

$$H_{max}(\omega) \leq \sqrt{\frac{H_{min}^2}{\beta(\omega)} \frac{\hat{\Phi}_y(\omega) - \hat{\Phi}_n(\omega)}{\hat{\Phi}_n(\omega)}} \tag{11}$$

By defining $H_{max}(\omega)=0$ for the special case where $H_{min}=0$ or $\hat{\Phi}_y(\omega)=\hat{\Phi}_n(\omega)$, these cases will also be covered by (11).

Since it is desirable that H(ω), and thereby also $H_{max}(\omega)$, is as large as possible in order to minimize the speech distortion, (11) can be reduced to $$H_{max}(\omega) = \sqrt{\frac{H_{min}^2}{\beta(\omega)} \frac{\hat{\Phi}_y(\omega) - \hat{\Phi}_n(\omega)}{\hat{\Phi}_n(\omega)}} \tag{12}$$

The tolerance threshold β(ω) defines a limit for how small the worst case SNR may be. β(ω) may take any value greater than zero. In noise suppression applications for mobile communication, the value of β(ω) could for example lie within the range −10 to 10 dB. A typical value of β(ω) in such applications could be −3 dB, which has proven to reduce the fluctuations of the residual noise to a level where the residual noise is unnoticeable for most values of $H_{min}(\omega)$, at a reasonable speech distortion cost.

The tolerance threshold could for example be selected according to $$\beta(\omega)=f(D_{acceptable}^{noise}) \tag{13a}$$

or $$\beta(\omega)=g(D_{acceptable}^{speech}) \tag{13b}$$

where f is an increasing function, g is a decreasing function, $D_{acceptable}^{noise}$ is the acceptable distortion of the noise, and $D_{acceptable}^{speech}$ is the acceptable distortion of the speech (relations from which a value of $D^{noise}$ and $D^{speech}$ may be obtained are given in expressions (21) and (22) below).

β(ω) may also take a constant value over parts of, or the entire, frequency range. If minimisation of the residual noise distortion is given higher priority than the minimization of the speech distortion, β should preferably be given a high value, such as for example in the order of +3 dB. If, on the other hand, a minimization of speech distortion is more important than a minimization of the residual noise, then β should preferably be given a lower value, for example in the order of −7 dB.

In one implementation of the invention, the value of β(ω) could depend on whether or not the noisy speech signal contains a speech component at a particular time and frequency.

If there is no speech component at the particular frequency, the value of $\beta(\omega)$ could be set to a comparatively high value, and when a speech component appears at this particular frequency, the value of $\beta(\omega)$ could advantageously be slowly decreased to a considerably smaller value. In decreasing the value of $\beta(\omega)$ slowly upon the presence of speech, it is achieved that an efficient noise suppression is obtained at times when no speech is present, and that the resulting distortion of speech at the particular frequency is gradually reduced in a manner so that a human ear listening to the signal does not notice the gradual change in the filtering of the speech component estimate.

$H_{max}$ Based on the Overall Signal to Noise Ratio $\overline{SNR}$

As mentioned above, $H_{max}(\omega)$ may be determined based on a consideration of the overall signal to noise ratio $\overline{SNR}$, where $$\overline{SNR} = \frac{\int_{w1}^{w2} \{\hat{\Phi}_y(\omega) - \hat{\Phi}_n(\omega)\} d\omega}{\int_{w1}^{w2} \hat{\Phi}_n(\omega) d\omega}. \quad (14)$$

A value of $H_{max}$ may for example be obtained from the following expression:

$$H_{max}=a[\overline{SNR}]^b+c \quad (15),$$

or from the following expression:

$$H_{max}=a \log_2[\overline{SNR}]+b \quad (16)$$

$H_{max}$ Based on the Noise Power Level $P_n(\omega)$

Furthermore, a value of $H_{max}(\omega)$ may alternatively be determined based on a consideration of the noise power level $P_n(\omega)$, for example by one of the relations provided in expression (17) or (18):

$$H_{max}(\omega)=a[P_n(\omega)]^{-b}+c \quad (17)$$

$$H_{max}(\omega)=a \log_2[P_n(\omega)]+b \quad (18)$$

$H_{max}$ Based on the Overall Noise Power Level $\overline{P}_n$ $H_{max}(\omega)$ may alternatively be determined based on a consideration of the overall noise power level $\overline{P}_n$, where $\overline{P}_n$ is the noise power level measured over a frequency region between $\omega_1$ and $\omega_2$.

A value of $H_{max}$ may for example be obtained from the following expression:

$$H_{max}=a[\overline{P}_n]^{-b}+c \quad (19),$$

or from the following expression:

$$H_{max}=a \log_2\overline{P}_n+b \quad (20)$$

In expressions (15)-(20) above, a, b and c are representing constants for which appropriate values may be derived experimentally. Other methods of determining the maximum level $H_{max}$ of the desired frequency response could also be used.

Figure 3:
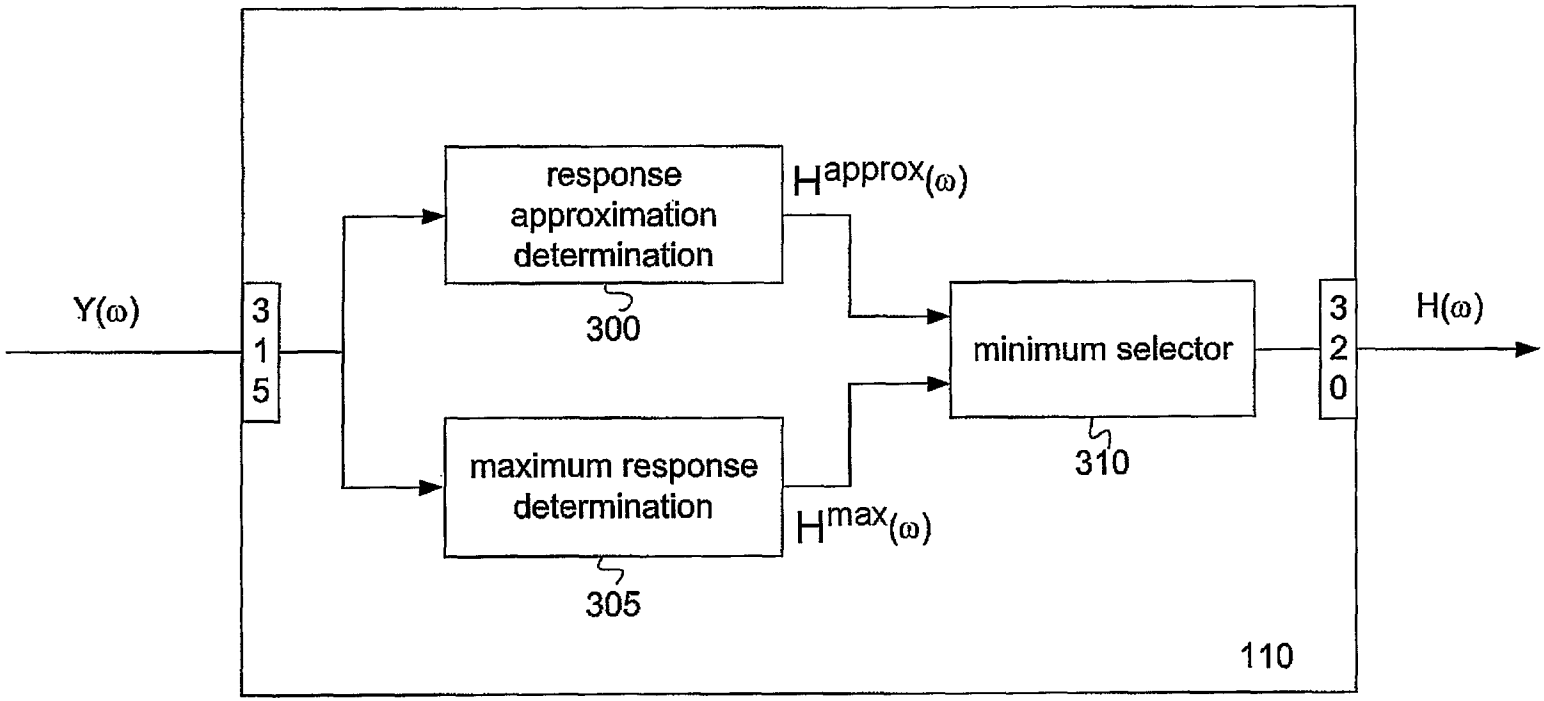
FIG. 3 is a schematic illustration of a desired response determination apparatus according to an embodiment of the invention.

An embodiment of the desired response determination apparatus 110 according to the invention is illustrated in FIG. 3. The desired response determination apparatus 110 of FIG. 3 comprises a response approximation determination apparatus 300, a maximum response determination apparatus 305 and minimum selector 310. The response approximation determination apparatus 300 is arranged to operate on a signal fed to the input 315 of the desired response determination apparatus 110, i.e. typically on the linear transform $Y(\omega)$ of the noisy speech signal. Furthermore, the response approximation determination apparatus 300 is arranged to determine an approximation $H^{approx}(\omega)$ of the desired frequency response based on the input signal. $H^{approx}(\omega)$ can advantageously be determined in a conventional manner for determining the desired frequency response, for example according to expression (4) above.

The maximum response determination apparatus 305 of FIG. 3 is arranged to determine a maximum level of the desired frequency response, $H_{max}(\omega)$. In many embodiments of the invention, the maximum response determination apparatus 305 will be arranged to receive and operate upon the linear transform $Y(\omega)$, or receive and operate upon the noisy speech signal y(t), in order to determine $H_{max}(\omega)$, for example according to any of expressions (12) or (15)-(20) above. (In the embodiment of FIG. 3, maximum response determination apparatus 305 is arranged to receive the linear transform $Y(\omega)$. However, in other embodiments, $H_{max}(\omega)$ will be determined in other ways—one of them being that $H_{max}(\omega)$ takes a constant value—and the connection between the input to the desired response determination apparatus 110 and the maximum response determination apparatus shown in FIG. 3 may be omitted.

In the apparatus shown in FIG. 3, the output of the response approximation determination apparatus 300, from which a signal representing $H^{approx}(\omega)$ will be delivered, and the output of the maximum response determination apparatus, from which a signal representing $H_{max}(\omega)$ will be delivered, are both connected to an input of minimum selector 310. The minimum selector 310 is arranged to compare the signal representing $H_{max}(\omega)$ and the signal $H^{approx}(\omega)$, and to select the lower of $H_{max}(\omega)$ and $H^{approx}(\omega)$. The minimum selector 310 is then arranged to output the lower of $H_{max}(\omega)$ and $H^{approx}(\omega)$. The output of minimum selector 310 represents the value of the desired frequency response $H(\omega)$, and the output of the minimum selector 310 is connected to the output 320 of the desired frequency response determination apparatus 110 so that the value representing the desired frequency response $H(\omega)$ can be fed to the output 320.

The desired response determination apparatus 110 of FIG. 3 may include other components, not shown in FIG. 3, such as a maximum selector arranged to compare a value of the frequency response to the minimum level of the desired frequency response, $H_{min}(\omega)$, and to select the maximum of such compared values. Such a maximum selector could advantageously be arranged to compare $H_{min}(\omega)$ to the output of the minimum selector 310, in which case the output of the maximum selector could advantageously be connected to the output 320 of the desired response determination apparatus 110. Alternatively, such a maximum selector could be arranged to compare $H_{min}(\omega)$ to the output from the response approximation determination apparatus 300, in which case the output of the maximum selector could advantageously be connected to the input of the minimum selector 310, instead of connecting the output of the response approximation determination apparatus 300 to the minimum selector 310 (cf. expressions (6a) and (6b) above). A desired response determination apparatus 110 could furthermore include other components such as buffers etc.

Figure 4B:
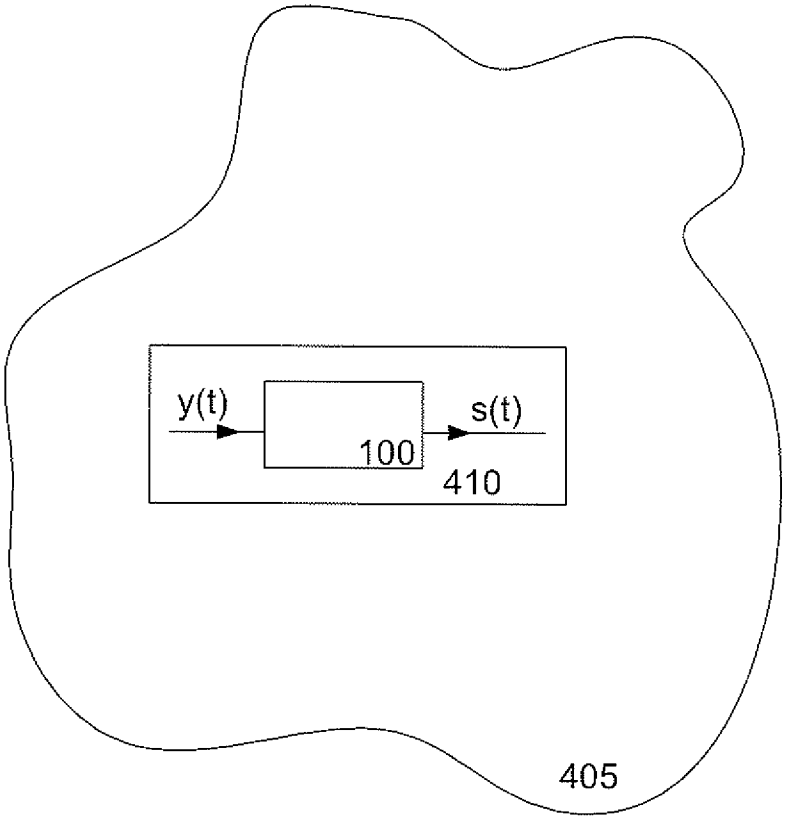
FIG. 4*b* is a schematic illustration of a node in a communications system wherein the node comprises a digital filter design apparatus according to the invention.
Figure 4A:
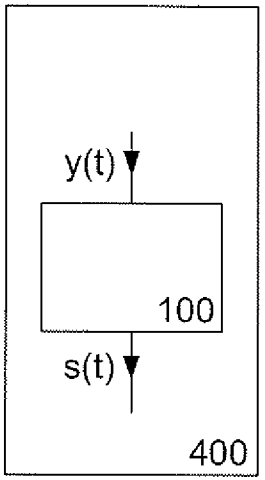
FIG. 4*a* is a schematic illustration of a user equipment incorporating a digital filter design apparatus according to the invention.

The desired frequency response determination apparatus 110 can advantageously be implemented by suitable computer software and/or hardware, as part of a filter design apparatus 100. A filter design apparatus 100 according to the invention can advantageously be implemented in user equipments for transmission of speech, such as mobile telephones, fixed line telephones, walkie-talkies etc. The filter design apparatus 100 may furthermore be implemented in other types of user equipments where acoustic signals are processed, such as cam-corders, dictaphones, etc. In FIG. 4*a*, a user equipment 400 comprising a filter design apparatus according to the invention is shown. A user equipment 400 could be arranged to perform noise suppression in accordance with the invention upon recording of an acoustic signal, and/or upon re-play of an acoustic signal that has been recorded at a different time and/or by a different user equipment.

Moreover, a filter design apparatus 100 according to the invention can advantageously be implemented in intermediary nodes in a communications system where it is desired to perform noise suppression, such as in a Media Resource Function Processor (MRFP) in an IP-Multimedia Subsystem (IMS system), in a Mobile Media Gateway etc. FIG. 4*b* shows a communications system 405 including a node 410 comprising a filter design apparatus 100 according to the invention.

Figure 5A:
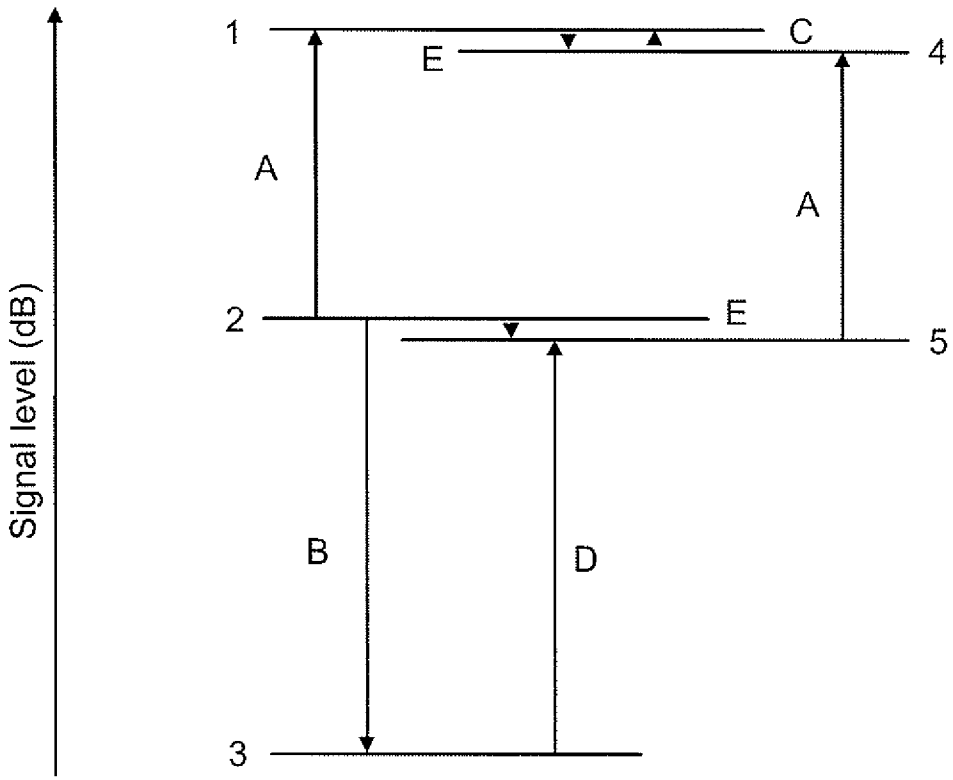
FIG. 5*a* illustrates results of simulations of signal filtering, wherein a conventional filter design method has been used.
Figure 5B:
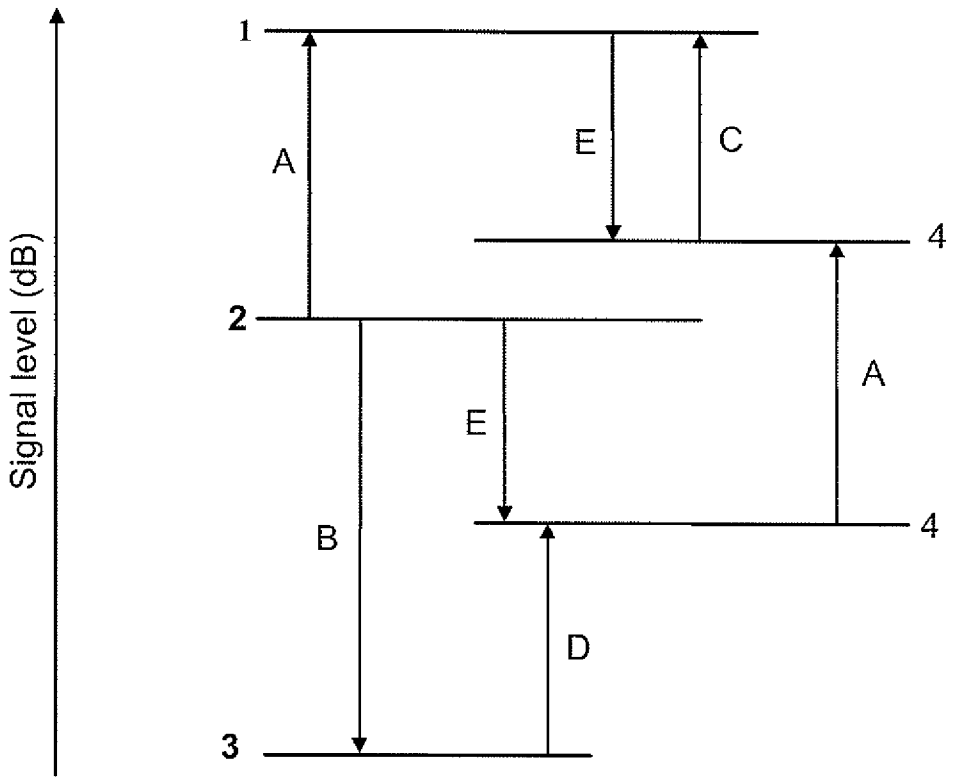
FIG. 5*b* illustrates results of simulations of signal filtering, wherein a filter design method according to the invention has been used.

Table 1, as well as FIGS. 5*a* and 5*b*, illustrate simulation results obtained by determining the desired frequency response H(t',ω') for a particular time t' and frequency ω' according to expression (4a) above (FIG. 5*a*), and by determining the desired frequency response H(t',ω') according to an embodiment of the invention (FIG. 5*b*). In FIG. 5*b*, H(t',ω') is determined by use of expression (6a), where $H_{max}(t',\omega')$ is obtained by use of expression (12), where $\beta(\omega')=3$ dB, and $H^{approx}(t',\omega')$ is obtained by expression (4). In FIG. 5*a*, the method used to obtain H(t',ω') imposes no upper limit on H(t',ω), i.e. $H_{max}^2=0$ dB, in a conventional manner. In both the simulations presented in FIG. 5*a* and those presented in FIG. 5*b*, the following values of the relevant parameters are used: $\delta(t',\omega')=1$, $\gamma_1=\gamma_2=1$, $H_{min}^2=-15$ dB, and the SNR of y(t') at the current time and frequency is 10 dB.

The following expression can be used as a measure of the distortion of the residual noise, $D^{noise}$:

$$D^{noise} = \frac{H^2(\omega)}{H_{min}^2} \tag{21}$$

while the distortion of the speech, $D^{speech}$, may be expressed as:

$$D^{speech} = \frac{1}{H^2(\omega)}. \tag{22}$$

$D^{noise}$ could also be used as a measure of the fluctuations of the residual noise.

In FIGS. 5*a* and 5*b*, five different signal levels are indicated:

1: The power spectral density $\hat{\Phi}_y(t',\omega')$ of the noisy speech signal y(t')

2: The power spectral density $\hat{\Phi}_n(t',\omega')$ of the noise component n(t')

3: Desired noise level, $\hat{\Phi}_n(t',\omega')-H_{min}^2$

4: Power spectral density of speech component estimate s(t'): $\hat{\Phi}_y(t',\omega')-H^2(t',\omega')$ 5: Power spectral density of the residual noise $n_{residual}(t')$: $\hat{\Phi}_n(t',\omega')-H^2(t',\omega')$ Furthermore, a number of different signal level differences are indicated in FIGS. 5*a* and 5*b:*

A: SNR(t) of the noisy speech signal y(t') as well as of speech component estimate ŝg(t') (10 dB)

B: $H_{min}^2$ (15 dB)

C: Speech distortion: $-H^2(t',\omega')$

D: Residual noise distortion, $H_{min}^2-H^2(t',\omega')$

E: $H^2(t',\omega')$

In table 1, values of $D^{noise}$ and $D^{speech}$, as well as values of the worst case signal-to-noise ratio, are given as obtained by the conventional method of determining H(ω) illustrated in FIG. 5*a*, and the inventive method illustrated in FIG. 5*b*.

TABLE 1

A comparison of the noise suppression obtained by a conventional noise suppression method and the noise suppression method according to an embodiment of the invention.

| | H (t', ω') determined according to (4a) | H (t', ω') determined according to (6) and (12) |
|---|---|---|
| $H^2(t',\omega')$ | −0.41 dB | −8 dB |
| $D^{noise}$ | 14.59 dB | 7 dB |
| $D^{speech}$ | 0.41 dB | 8 dB |
| Worst case SNR | −4.59 dB | 3 dB |

From the simulation results illustrated by FIGS. 5*a* and 5*b* as well as table 1, it is clear that the residual noise distortion and the worst case SNR obtained by the inventive method is better than those obtained by a conventional noise suppression technique. This improvement is generally obtained at the cost of an increase in speech distortion. In many cases, however, an increase in speech distortion is acceptable, if the fluctuations in the residual noise are reduced. Furthermore, it is clear from the above that the effects of the trade-offs made according to the invention between the distortions in the residual noise and the speech can easily be computed. Hence, a decision on whether or not to apply the inventive method for selecting the desired frequency response of a filter arrangement can be made based on an analysis of what consequences the application of the inventive method would have on the speech distortion contra the residual noise distortion. Such analysis could be made from time to time, and a decision could be made on whether or not to apply the inventive method of determining MO could be made, based on the analysis. If it is found that a switch-over from a conventional manner of determining H(ω) to a method according to the invention would be appropriate, such a switch-over could advantageously be made gradually, in order to achieve a seamless transition that is not noticeable to the listener.

By the invention, a flexible and computationally simple way of determining the desired frequency response H(ω) of a digital filter is obtained. By applying the method, fluctuations of the residual noise may be reduced in a controlled manner, and the necessary trade-off between the amount of fluctuations in the residual noise and the speech distortion becomes rather simple. The invention can successfully be applied to any noise reduction method based on spectral subtraction.

In the above, the invention has been discussed in terms of the noise suppression of noisy speech signals. However, the invention can also advantageously be applied for noise suppression in other types of acoustic recordings. The signal y(t) in which the noise is to be suppressed is in the above referred to as a noisy speech signal, but could be any type of noisy acoustic recording.

One skilled in the art will appreciate that the present invention is not limited to the embodiments disclosed in the accompanying drawings and the foregoing detailed description, which are presented for purposes of illustration only, but it can be implemented in a number of different ways, and it is defined by the following claims.

The invention claimed is:

1. A method implemented by a digital filter design processor of designing a noise suppression filter to filter an input signal representing an acoustic recording, the method comprising:

determining, by a digital filter design processor, a desired frequency response of the noise suppression filter by:

determining a maximum level of the desired frequency response in response to the input signal to be filtered and in dependence on a minimum level, wherein the maximum level determined by:

$$H_{max}(\omega) = \max\left\{\sqrt{\frac{H_{min}^2}{\beta}\frac{(\hat{\Phi}_y(\omega)-\hat{\Phi}_n(\omega))}{\hat{\Phi}_n(\omega)}},\ H_{min}\right\},$$

wherein $H_{max}(\omega)$ is the maximum level as a function of frequency, $H_{min}$ is a minimum level of the desired frequency response, $\beta$ is a tolerance threshold representing a maximum acceptable signal-to-noise ratio, $\hat{\Phi}_y(\omega)$ is a spectral density of the input signal as a function of frequency, $\hat{\Phi}_n(\omega)$ is a spectral density of a noise component of the input signal as a function of frequency, $(\hat{\Phi}_y(\omega)-\hat{\Phi}_n(\omega)$ is a spectral density of an estimated desired component of the input signal as a function of frequency, and $$\left(\frac{(\hat{\Phi}_y(\omega)-\hat{\Phi}_n(\omega))}{\hat{\Phi}_n(\omega)}\right)$$

is an estimate of a signal-to-noise ratio of the input signal to be filtered as a function of frequency;

determining an approximation of the desired frequency response using the input signal;

comparing the approximation with the maximum level; and determining the desired frequency response based on the comparison of the approximation with the maximum level such that the desired frequency response does not exceed the maximum level and does not take a value lower than the minimum level;

generating, by the digital filter design processor, a noise suppression filter based on the desired frequency response; and filtering, by the noise suppression filter, the input signal representing the acoustic recording for use in recording and/or playback of the filtered input signal.

2. The method of claim 1, wherein the steps of determining an approximation, determining a maximum level, comparing and selecting are repeated for at least two different frequency bins.

3. The method of claim 1, wherein the maximum level is determined based on a measure of a noise level of the input signal to be filtered.

4. The method of claim 3, wherein the maximum level at a particular frequency is determined in dependence of an estimate of the signal-to-noise ratio of the input signal to be filtered at the particular frequency.

5. The method of claim 3, wherein the maximum level is determined in dependence of an estimate of the overall value of the signal-to-noise ratio.

6. The method of claim 3, wherein the maximum level at a particular frequency is determined in dependence of an estimate of the noise power of the input signal be filtered at the particular frequency.

7. The method of claim 3, wherein the maximum level is determined in dependence of an estimate of the noise power of the input signal.

8. The method of claim 1, wherein a value of the tolerance threshold depends on a frequency for which the maximum level is determined.

9. The method of claim 1, wherein the desired frequency response is associated with a frequency response of the input signal.

10. A digital filter design processor arranged to design a noise suppression filter to filter an input signal representing an acoustic recording, the digital filter design processor comprising:

a desired frequency response determination processor for determining a desired frequency response for the noise suppression filter, said desired frequency response determination processor configured to:

determine a maximum level of the desired frequency response in response to the input signal to be filtered and in dependence on a minimum level of the desired frequency response, wherein the maximum level is determined by:

$$H_{max}(\omega) = \max\left\{\sqrt{\frac{H_{min}^2}{\beta}\frac{(\hat{\Phi}_y(\omega)-\hat{\Phi}_n(\omega))}{\hat{\Phi}_n(\omega)}},\ H_{min}\right\},$$

wherein $H_{max}(\omega)$ is the maximum level as a function of frequency, $H_{min}$ is a minimum level of the desired frequency response, $\beta$ is a tolerance threshold representing a maximum acceptable signal-to-noise ratio, $\hat{\hat{\Phi}}_y(\omega)$ is a spectral density of the input signal as a function of frequency, $\hat{\Phi}_n(\omega)$ is a spectral density of a noise component of the input signal as a function of frequency, $(\hat{\Phi}_y(\omega)-\hat{\Phi}_n(\omega))$ is a spectral density of an estimated desired component of the input signal as a function of frequency, and $$\left(\frac{(\hat{\Phi}_y(\omega)-\hat{\Phi}_n(\omega))}{\hat{\Phi}_n(\omega)}\right)$$

is an estimate of a signal-to-noise ratio of the input signal to be filtered as a function of frequency;

determine an approximation of the desired frequency response using the input signal;

compare the approximation of the desired frequency response with the maximum level; and determine the desired frequency response based on the comparison of the approximation with the maximum level so that the desired frequency response does not exceed the maximum level and does not take a value lower than the minimum level;

a filter signal generation processor configured to generate the noise suppression filter based on the desired frequency response; and the noise suppression filter configured to filter the input signal representing the acoustic recording for use in recording and/or playback of the filtered input signal.

11. The digital filter design processor of claim 10, wherein the desired frequency response processor is arranged to compare and select on a per frequency bin basis.

12. The digital filter design processor of claim 10, wherein the desired frequency response apparatus is arranged to determine the maximum level based on a measure of the noise level of the input signal to be filtered.

13. The digital filter design processor of claim 10, wherein the desired frequency response is associated with a frequency response of the input signal.

14. A user equipment for processing of an acoustic signal, the user equipment including a digital filter design processor arranged to design a noise suppression filter to filter an input signal representing an acoustic recording, the digital filter design processor comprising:

a desired frequency response determination processor for determining a desired frequency response for the noise suppression filter, said desired frequency response determination processor configured to:

determine a maximum level of the desired frequency response in response to the input signal to be filtered and in dependence on a minimum level of the desired frequency response, wherein the maximum level is determined by:

$$H_{max}(\omega) = \max\left\{\sqrt{\frac{H_{min}^2}{\beta}\frac{(\hat{\Phi}_y(\omega)-\hat{\Phi}_n(\omega))}{\hat{\Phi}_n(\omega)}},\ H_{min}\right\},$$

wherein $H_{max}(\omega)$ is the maximum level as a function of frequency, $H_{min}$ is a minimum level of the desired frequency response, $\beta$ is a tolerance threshold representing a maximum acceptable signal-to-noise ratio, $\hat{\Phi}_y(\omega)$ is a spectral density of the input signal as a function of frequency, $\hat{\Phi}_n(\omega)$ is a spectral density of a noise component of the input signal as a function of frequency, $(\hat{\Phi}_y(\omega)-\hat{\Phi}_n(\omega))$ is a spectral density of an estimated desired component of the input signal as a function of frequency, and $$\left(\frac{(\hat{\Phi}_y(\omega)-\hat{\Phi}_n(\omega))}{\hat{\Phi}_n(\omega)}\right)$$

is an estimate of a signal-to-noise ratio of the input signal to be filtered as a function of frequency;

determine an approximation of the desired frequency response using the input signal;

compare the approximation with the determined maximum level; and determine the desired frequency response based on the comparison of the approximation with the maximum level so that the desired frequency response docs does not exceed the maximum level and does not take a value lower than the minimum level; and a filter signal generation processor configured to generate the noise suppression filter based on the desired frequency response; and the noise suppression filter configured to filter the input signal representing the acoustic recording for use in recording and/or playback of the filtered input signal.

15. The user equipment of claim 14, wherein the desired frequency response is associated with a frequency response of the input signal.

16. A node for relaying a signal representing voice in a communications system, the node including a digital filter design processor arranged to design a noise suppression filter to filter an input signal representing voice, the digital filter design processor comprising:

a desired frequency response determination processor for determining a desired frequency response for the noise suppression filter, said desired frequency response determination processor configured to:

determine a maximum level of the desired frequency response in response to the input signal to be filtered and in dependence on a minimum level of the desired frequency response, wherein the maximum level is determined by:

$$H_{max}(\omega) = \max\left\{\sqrt{\frac{H_{min}^2}{\beta}\frac{(\hat{\Phi}_y(\omega)-\hat{\Phi}_n(\omega))}{\hat{\Phi}_n(\omega)}},\ H_{min}\right\},$$

wherein $H_{max}(\omega)$ is the maximum level as a function of frequency, $H_{min}$ is a minimum level of the desired frequency response, $\beta$ is a tolerance threshold representing a maximum acceptable signal-to-noise ratio, $\hat{\Phi}_y(\omega)$ is a spectral density of the input signal as a function of frequency, $\hat{\Phi}_n(\omega)$ is a spectral density of a noise component of the input signal as a function of frequency, $(\hat{\Phi}_y(\omega)-\hat{\Phi}_n(\omega))$ is a spectral density of an estimated desired component of the input signal as a function of frequency, and $$\left(\frac{(\hat{\Phi}_y(\omega)-\hat{\Phi}_n(\omega))}{\hat{\Phi}_n(\omega)}\right)$$

is an estimate of a signal-to-noise ratio of the input signal to be filtered as a function of frequency;

determine an approximation of the desired frequency response using the input signal;

compare the approximation with the determined maximum level; and determine the desired frequency response based on the comparison of the approximation with the maximum level, so that the desired frequency response does not exceed the maximum level and does not take a value lower than the minimum level; and a filter signal generation processor configured to generate the noise suppression filter based on the desired frequency response; and the noise suppression filter configured to filter the input signal representing the acoustic recording for use in recording and/or playback of the filtered input signal.

17. The node of claim 16, wherein the desired frequency response is associated with a frequency response of the input signal.

18. A non-transitory computer-readable medium including program code for designing a noise suppression filter to filter an input signal representing an acoustic recording, the program code comprising computer-executable instructions that when executed by a computer causes the computer to perform operations, wherein the operations are configured to:

determine a maximum level of the desired frequency response in response to the input signal to be filtered and in dependence on a minimum level, wherein the maximum level is determined by:

$$H_{max}(\omega) = \max\left\{\sqrt{\frac{H_{min}^2}{\beta}\frac{(\hat{\Phi}_y(\omega) - \hat{\Phi}_n(\omega))}{\hat{\Phi}_n(\omega)}}, H_{min}\right\},$$

wherein $H_{max}(\omega)$ is the maximum level as a function of frequency, $H_{min}$ is a minimum level of the desired frequency response, $\beta$ is a tolerance threshold representing a maximum acceptable signal-to-noise ratio, $\hat{\Phi}_y(\omega)$ is a spectral density of the input signal as a function of frequency, $\hat{\Phi}_n(\omega)$ is a spectral density of a noise component of the input signal as a function of frequency, $(\hat{\Phi}_y(\omega)-\hat{\Phi}_n(\omega))$ is a spectral density of an estimated desired component of the input signal as a function of frequency, and $$\left(\frac{(\hat{\Phi}_y(\omega) - \hat{\Phi}_n(\omega))}{\hat{\Phi}_n(\omega)}\right)$$

is an estimate of a signal-to-noise ratio of the input signal to be filtered as a function of frequency;

determine an approximation of the desired frequency response using the input signal;

compare the approximation with the maximum level;

determine the desired frequency response based on the comparison of the approximation with the maximum level, such that the desired frequency response does not exceed a maximum level and does not take a value lower than a minimum level; and generate a noise suppression filter based on the desired frequency response; and filter the input signal representing the acoustic recording for use in recording and/or playback of the filtered input signal.

19. The computer-readable medium of claim 18, wherein the desired frequency response is associated with a frequency response of the input signal.

* * * * *